US007832605B2

(12) United States Patent
Bertucci

(10) Patent No.: US 7,832,605 B2
(45) Date of Patent: Nov. 16, 2010

(54) WATCH BAND CONSTRUCTION

(76) Inventor: Michael H Bertucci, 991 Charles Ave., Gurnee, IL (US) 60031

( * ) Notice: Subject to any disclaimer, the term of this patent is extended or adjusted under 35 U.S.C. 154(b) by 586 days.

(21) Appl. No.: 11/350,038

(22) Filed: Feb. 8, 2006

(65) Prior Publication Data

US 2006/0226181 A1 Oct. 12, 2006

Related U.S. Application Data

(60) Provisional application No. 60/670,471, filed on Apr. 12, 2005.

(51) Int. Cl.

| | |
|---|---|
| ***A44C 5/14*** | (2006.01) |
| ***A44C 5/00*** | (2006.01) |
| ***A41F 19/00*** | (2006.01) |
| ***A41F 9/00*** | (2006.01) |

(52) U.S. Cl. ..... 224/164; 224/166; 224/167; 224/168; 224/169; 224/178; 2/310; 2/311; 2/312; 2/319; 2/321

(58) Field of Classification Search ..... 224/164, 224/166, 167, 168, 169, 174, 178; 2/310, 2/311, 312, 319, 321, 338

See application file for complete search history.

(56) References Cited

U.S. PATENT DOCUMENTS

| | | | | |
|---|---|---|---|---|
| 1,333,421 | A * | 3/1920 | Jolly | 24/186 |
| 1,626,160 | A * | 4/1927 | Schwalberg | 224/178 |
| 4,498,201 | A * | 2/1985 | Carter | 2/312 |
| 4,944,043 | A * | 7/1990 | Bush | 2/308 |
| 5,031,576 | A * | 7/1991 | Weinberg | 119/865 |
| 5,367,714 | A * | 11/1994 | Hines et al. | 2/311 |
| 5,873,133 | A * | 2/1999 | Jurga et al. | 2/322 |
| 6,179,177 | B1 * | 1/2001 | Hihara et al. | 224/164 |
| 6,449,815 | B1 * | 9/2002 | Spiller | 24/306 |
| 7,275,667 | B2 * | 10/2007 | Bertucci | 224/178 |

* cited by examiner

*Primary Examiner*—Nathan J Newhouse
*Assistant Examiner*—Lester L Vanterpool
(74) *Attorney, Agent, or Firm*—Clark Hill PLC

(57) ABSTRACT

A strap-type watch band construction is fabricated from a blank. The blank includes three sections. A first section is folded over forming a double layer portion that is stitched and secures a buckle and a keeper and supports a watch casing, which is preferably slidably supported thereon. A second section is a single layer of the blank, extends from the first section, and includes apertures therethrough for receiving the buckle. A third section extends from the second section and is folded over to form a tip portion. The third section improves gripping and facilitates insertion of the tip portion through the buckle and the keeper. The single layer construction of the second section facilitates putting the watch band construction on the wrist as it is flexible and tends to form around the wrist.

10 Claims, 4 Drawing Sheets

WATCH BAND CONSTRUCTION

CROSS-REFERENCE AND INCORPORATION BY REFERENCE

This patent application claims the benefit of domestic priority of U.S. Provisional Application Ser. No. 60/670,471, filed Apr. 12, 2005, and entitled "Watch Band Construction". U.S. Provisional Application Ser. No. 60/670,471 is hereby incorporated by reference.

BACKGROUND OF THE INVENTION

The present invention relates to a novel construction for a strap-type watch band.

There are a number of watch band constructions known in the art. All of these watch band constructions have a number of characteristics, such as durability, comfort, styling, ease of use, etc., which are provided in varying degrees. For example, many watch band constructions provide for high durability, but in doing so, lack the ideal characteristics of comfort, styling and ease of use. The opposite can also be true. Thus, it is a disadvantage that watch band constructions of the prior art do not provide for high degrees of each of these characteristics.

Thus, there is a need for a watch band construction which overcomes the disadvantages of prior art watch band constructions. The present invention provides such a watch band construction. Other features and advantages of the present invention will become apparent upon a reading of the attached specification in combination with a study of the drawings.

SUMMARY OF THE INVENTION

Briefly, and in accordance with the foregoing, the invention provides a strap-type watch band construction which is fabricated from a single piece of blank-type material, preferably nylon, which increases durability, comfort, ergonomics and ease of use. The blank material includes three sections. A first section is folded over forming a double layer portion that is stitched and secures both the buckle and the keeper elements of the watch band construction. The double layer portion also will support a watch casing, which is preferably slidably supported thereon. A second section extends from the first section and includes a series of apertures, and is of a single layer construction to promote flexibility. A third section extends from the second section and is folded over to form a front tip portion of the watch band construction. The third section, which is the novel front tip portion, improves gripping and facilitates insertion of the tip portion through both the buckle and the keeper when putting the watch band construction on the wrist. The front tip design of the invention also eliminates the raw edge of the nylon, forming a more durable, non-fraying turned edge. The apertures of the watch band construction are provided in the second section, of a single layer construction, such that putting the watch band construction on the wrist is easier as the second section tends to form around the wrist.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 1:
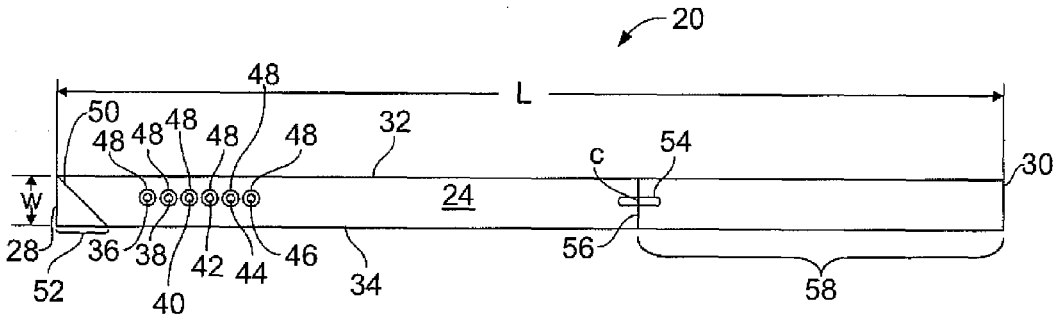
FIG. 1 is a top plan elevational view of a blank used in forming the watch band construction of the invention.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

Figure 2:
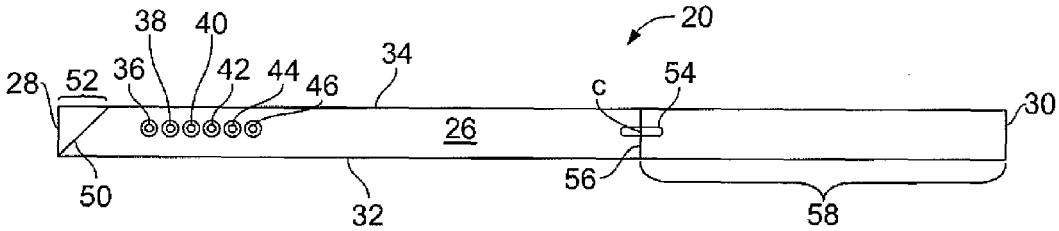
FIG. 2 is a bottom plan elevational view of the blank of FIG. 1 used in forming the watch band construction of the invention.
Figure 4:
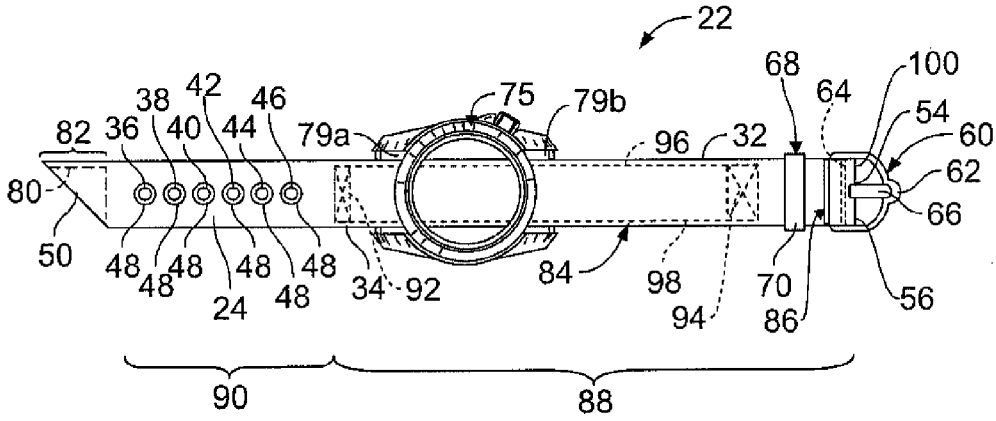
FIG. 4 is a top plan elevational view of the completed watch band construction of the invention having the watch casing slidably supported thereon.
Figure 5:
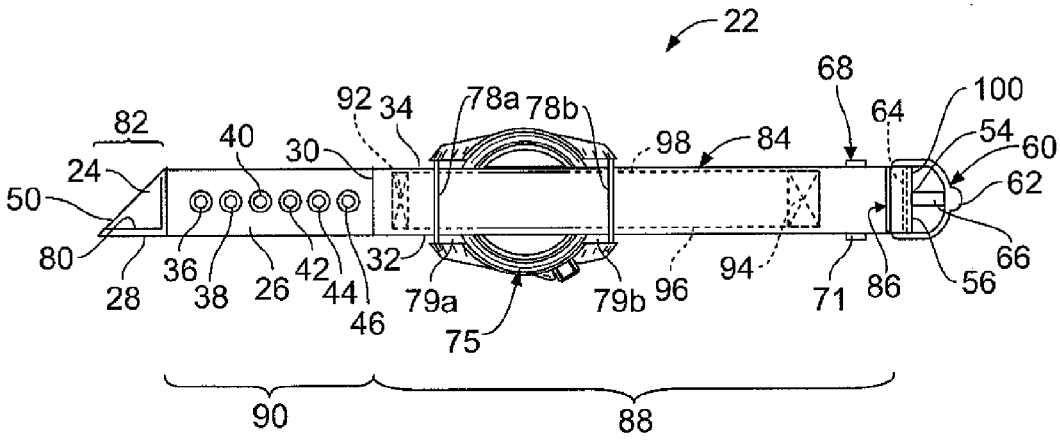
FIG. 5 is a bottom plan elevational view of the completed watch band construction of the invention having the watch casing slidably supported thereon.

FIGS. 1 and 2 illustrate a watch band blank 20 used in forming a strap-type watch band construction 22 illustrated in FIGS. 4 and 5. It should be noted that while the blank 20 and the completed watch band construction 22 have been described hereinbelow as having certain dimensions, that these dimensions should be understood to be only one preferred embodiment of the blank 20 and the watch band construction 22 where the blank 20 has a thickness of seven-eighths (0.875) of an inch, and are provided merely for reference purposes. The dimensions may be changed or adjusted as desired while keeping with the spirit of the invention. It should further be noted that the drawings illustrating the blank 20 and the watch band construction 22 are not necessarily drawn to scale.

The blank 20 is preferably formed of nylon, but can be formed from other materials as desired. The blank 20 is preferably rectangular in construction such that it has a top surface 24, illustrated in FIG. 1, a bottom surface 26, illustrated in FIG. 2, a first end 28, a second end 30 which is opposite the first end 28, a first side edge 32 which extends from one end of the first end 28 to one end of the second end 30, and a second side edge 34 which extends from another end of the first end 28 to another end of the second end 30. In a preferred embodiment, a length L of the blank 20, which is defined as the distance from the first end 28 to the second end 30, or the distance which either the first or second side edges 32, 34 extend, is sixteen and nine-tenths (16.9) inches. Also, in a preferred embodiment, a width W of the blank 20, which is defined as the distance from the first side edge 32 to the second side edge 34, or the distance which either the first or second ends 28, 30 extend, is seven-eighths (0.875) of an inch.

The blank 20 preferably has first, second, third, fourth, fifth and sixth apertures 36, 38, 40, 42, 44, 46 provided therethrough, although more or less apertures could be provided as desired. Each of the apertures 36, 38, 40, 42, 44, 46 are preferably circular in configuration. Centers of the apertures 36, 38, 40, 42, 44, 46 are preferably provided equidistant from the first and second side edges 32, 34, such that in the preferred embodiment, the center of each of the apertures 36, 38, 40, 42, 44, 46 is provided at a distance of seven-sixteenths (0.4375) inches from both the first and second edges 32, 34. The center of the first aperture 36 is preferably provided at a distance of one and three-tenths (1.3) inches from the first end 28 of the watch band 20. The center of the second aperture 38 is preferably provided at a distance of one and twenty-seven-fortieths (1.675) inches from the first end 28 of the watch band 20 and, thus, three-eighths (0.375) of an inch from the center of the first aperture 36. The center of the third aperture 40 is preferably provided at a distance of two and one-twentieth (2.05) inches from the first end 28 of the watch band 20 and, thus, three-eighths (0.375) of an inch from the center of the second aperture 38. The center of the fourth aperture 42 is preferably provided at a distance of two and seventeen-fortieths (2.425) inches from the first end 28 of the watch band 20 and, thus, three-eighths (0.375) of an inch from the center of the third aperture 40. The center of the fifth aperture 44 is preferably provided at a distance of two and eight-tenths (2.8) inches from the first end 28 of the watch band 20 and, thus, three-eighths (0.375) of an inch from the center of the fourth aperture 42. The center of the sixth aperture 46 is preferably provided at a distance of three and seven-fortieths (3.175) inches from the first end 28 of the blank 20 and, thus, three-eighths (0.375) of an inch from the center of the fourth aperture 44.

A grommet 48 is provided in each of the apertures 36, 38, 40, 42, 44, 46 and extends from the top surface 24 of the watch band 20 to the bottom surface 26 of the watch band 20. An inner diameter of each of the grommets 48 is preferably one-fortieth (0.025) of an inch such that the diameter of the apertures 36, 38, 40, 42, 44, 46 is slightly larger than the inner diameter of the grommets 48. The grommets 48 are preferably formed of metal, but may be formed of any other material as desired, but should preferably be formed of a material which will prevent the apertures 36, 38, 40, 42, 44, 46 of the watch band 20 from becoming frayed with repeated use.

Figure 8:
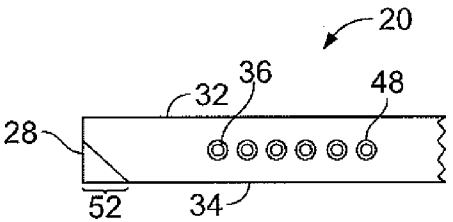
FIGS. 6-11 illustrate partial top elevational views of an end of the blank used in forming the watch band construction of the invention with alternative fold line designs for the formation of a tip portion of the watch band construction.
Figure 7:
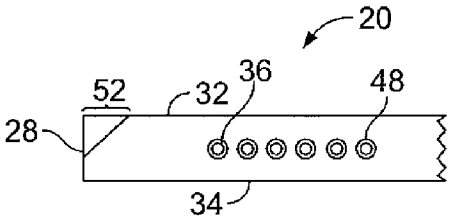
Figure 6:
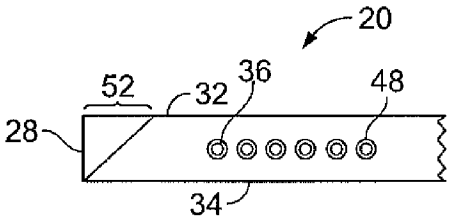
Figure 11:
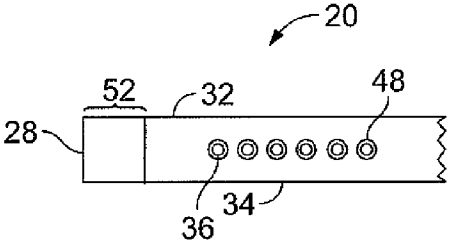
Figure 10:
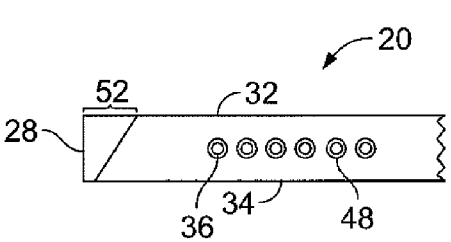
Figure 9:
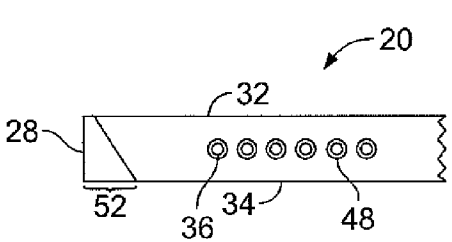

As illustrated in FIGS. 1 and 2, the blank 20 is provided with a fold line 50 proximate to the first end 28 thereof. The fold line 50 is preferably angled from the connection of the first end 28 and the first side edge 32 to the second side edge 34, preferably at an angle of forty-five (45) degrees, but the fold line 50 could be provided at other angles as desired. Alternatively, the fold line 50 could be provided in numerous other positions on the blank 20, such as: angled from the connection of the first end 28 and the second side edge 34 to the first side edge 32 as illustrated in FIG. 6; angled from a position along the first end 28 between the first and second side edges 32, 34 to either the first or second side edge 32, 34 as illustrated in FIGS. 7 and 8; angled from a position along the first side edge 32 proximate to the first end 28 to the second side edge 34 as illustrated in FIG. 9; angled from a position along the second side edge 34 proximate to the first end 28 to the first side edge 32 as illustrated in FIG. 10; or extending straight downwardly from the first side edge 32 proximate to the first end 28 to the second side edge 34 as illustrated in FIG. 11. The portion of the blank 20 which is provided between the fold line 50 and the first end 28 is defined hereinafter as the foldable portion 52 and the purpose for providing the fold line 50 and the foldable portion 52 will be discussed in further detail herein.

The blank 20 has an additional, seventh aperture 54 provided therethrough intermediate the first and second ends 28, 30. The aperture 54 preferably has a configuration which is oblong with curved ends. A center C of the aperture 54 is preferably provided equidistant from the first and second side edges 32, 34, such that in the preferred embodiment, the center C of the aperture 54 is provided at a distance of seven-sixteenths (0.4375) of an inch from both the first and second side edges 32, 34. A width of the aperture 54 is preferably one-eighth (0.125) of an inch. A length of the aperture 54 can be determined as desired. The curved ends of the aperture 54 preferably are formed at a radius of one-sixteenth (0.0625) of an inch. The center C of the aperture 54 is preferably provided at a distance of ten and one-quarter (10.25) inches from the first end 28 of the blank 20.

The blank 20 is provided with a fold line 56 intermediate the first and second ends 28, 30 which extends straight downwardly from the first side edge 32 to the second side edge 34. The fold line 56 is such that if the aperture 54 were not provided in the blank 20, the fold line 56 would preferably extend through where the center C of the aperture 54 would be provided. Thus, the fold line 56 is generally parallel to the first and second ends 28, 30 and is positioned a distance of ten and one-quarter (10.25) inches from the first end 28 and appears to generally bisect the aperture 54. The portion of the blank 20 which is provided between the fold line 56 and the second end 30 is defined hereinafter as the foldable portion 58 and the purpose for providing the fold line 56 and the foldable portion 58 will be discussed in further detail herein.

Figure 3A:
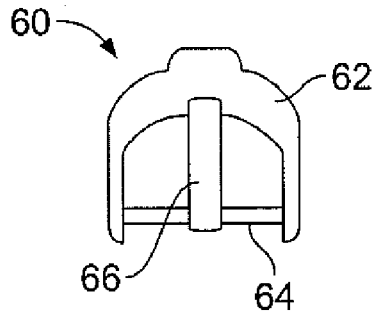
FIG. 3A is a top plan elevational view of a typical buckle used in the watch band construction of the invention.

FIG. 3A illustrates a watch buckle 60 used in forming the watch band construction 22 of the invention. The watch buckle 60 is of a type well-known in the art and, therefore, will not be described in detail herein other than to denote a U-shaped portion 62, a pin member 64, and a prong 66.

Figure 3B:
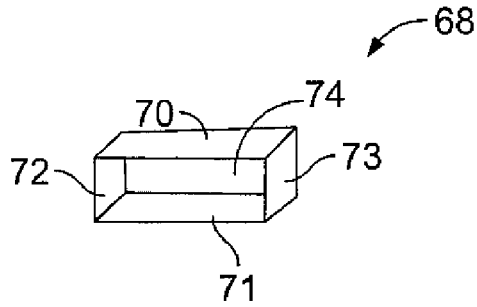
FIG. 3B is a perspective view of a typical keeper used in the watch band construction of the invention.

FIG. 3B illustrates a keeper 68 used in forming the watch band construction 22 of the invention. The keeper 68 is of a type well-known in the art and, therefore will not be described in detail herein other than to denote that the keeper 68 is generally defined by generally rectangular top and bottom portions 70, 71 and generally rectangular side portions 72, 73 which connect the top and bottom portions 70, 71 together such that an aperture 74 is provided through the keeper 68.

Figure 3C:
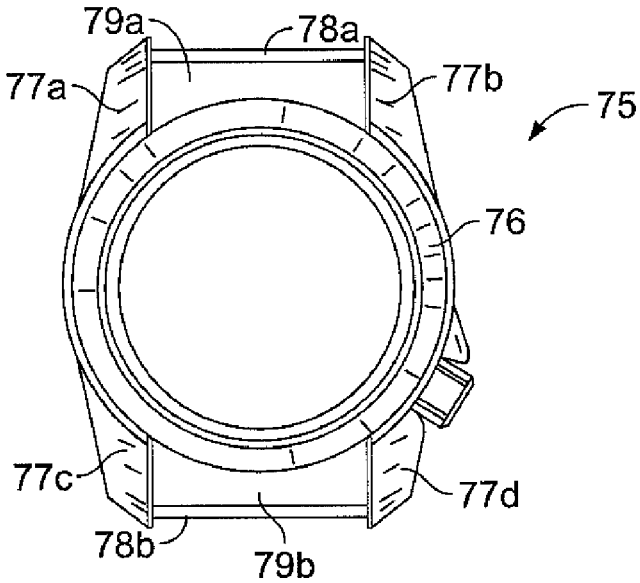
FIG. 3C is a top plan elevational view of a typical watch casing to be supported by the watch band construction of the invention.

FIG. 3C illustrates a watch casing 75 to be supported by the watch band construction 22 of the invention. The watch casing 75 is of a type well-known in the art, for example those generally illustrated in U.S. Pat. Nos. 488,075, 488,388 and 488,728. Therefore, the watch casing 75 will not be described in detail herein other than to denote that the watch casing 74 is generally defined by a face portion 76 having flange portions 77*a*, 77*b* extending outwardly therefrom on one side of the face portion 76 and flange portions 77*c*, 77*d* extending outwardly therefrom on an opposite side of the face portion 76. A pin 78*a* extends between flange members 77*a*, 77*b* such that an aperture 79*a* is provided between the flange members 77*a*, 77*b*, the pin 78*a* and the face portion 76. Likewise, a pin 78*b* extends between flange members 77*c*, 77*d* such that an aperture 79*b* is provided between the flange members 77*c*, 77*d*, the pin 78*b* and the face portion 76.

Formation of the watch band construction 22 of the invention will now be described, primarily with reference to FIGS. 4 and 5.

The foldable portion 52 is folded along the fold line 50 such that the bottom surface 26 of the foldable portion 52 faces the bottom surface 26 of the blank 20. The foldable portion 52 is secured to the blank 20, which it is folded under, preferably by stitching 80. The folding and securing of the foldable portion 52 to the blank 20 forms a tip portion 82 of the watch band construction 22, such that the tip portion 82 includes two layers of the blank 20. It should be noted that the tip portion 82 formed is not of a size which impedes access to any of the apertures 36, 38, 40, 42, 44, 46 through the grommets 48 as the tip portion 82 is provided to the left of all of the apertures 36, 38, 40, 42, 44, 46, when viewed as in FIGS. 4 and 5.

The second end 30 of the blank 20 is inserted through the aperture 74 of the keeper 68 such that the keeper 68 is positioned proximate to the fold line 56, but is positioned on the side of the fold line 56 which is closer to the first end 28 or tip portion 82. The keeper 68 is not positioned on the foldable portion 58. It should be noted that either the first end 28 of the blank 20 or the tip portion 82, if previously provided, could instead be inserted through the aperture 74 of the keeper 68, rather than the second end 30 of the blank 20.

The watch buckle 60 is secured to the watch band 20 by inserting the prong 66 through the aperture 54 from the bottom surface 26 to the top surface 24. The pin member 64 of the watch buckle 60 is provided along the bottom surface 26 of the blank 20 proximate to the fold line 56 such that the U-shaped portion 62 of the watch buckle 60 extends around the first and second side edges 32, 34 of the blank 20 such that the prong 66 can be positioned against the U-shaped portion 62.

The foldable portion 58 of the blank 20 is then folded along the fold line 56 such that the bottom surface 26 of the foldable portion 58 is positioned against the bottom surface 26 of the blank 20. The foldable portion 58 is secured to the blank 20 which it is folded under, preferably by first and second stitchings 84, 86. The folding under and securing of the foldable portion 58 to the blank 20 forms a double layer portion 88 of the watch band construction 22. The foldable portion 58 of the blank 20 is folded under such that the second end 30 of the blank 20 is positioned proximate to the sixth aperture 46 extending through the blank 20, but it should be noted that the double layer portion 88 formed is not of a size which impedes access to any of the apertures 36, 38, 40, 42, 44, 46 through the grommets 48 as the double layer portion 88 is provided to the right of all of the apertures 36, 38, 40, 42, 44, 46, when viewed as in FIGS. 4 and 5. A single layer portion 90 is thus provided between the tip portion 82 and the double layer portion 88. The single layer portion 90 includes only a single layer of the blank 20 and the apertures 36, 38, 40, 42, 44, 46 and the grommets 48.

The first stitching 84 which secures the foldable portion 58 to the blank 20 in order to form the double layer portion 88 is preferably provided to have a first box stitch 92 proximate to the second end 28 and a second box stitch 94 proximate to the keeper 68. Edge stitchings 96, 98 are preferably provided along the first and second side edges 32, 34, respectively, between the first and second box stitches 92, 94. The second stitching 86 is also provided between the keeper 68 and the watch buckle 60 generally from the first side edge 32 to the second side edge 34.

The bottom portion 71 of the keeper 68 is thus secured between the second box stitch 94 and the second stitching 86 of the double layer portion 88 such that the top portion 70 of the keeper 68 is positioned at a distance above the top surface 24 of the double layer portion 88 by the side portions 72, 73 of the keeper 68.

The pin member 64 of the watch buckle 60 is thus secured between the second stitching 86 and the fold line 56 at an extreme end 100 of the double layer portion 88, where the prong 66 extends outwardly out of the aperture 54. The second stitching 86 and the folding along fold line 56 gives tremendous strength to the watch buckle 60 as it is tightly secured between the second stitching 86 and the folding along fold line 56.

The watch band construction 22 is thus formed.

The watch casing 75 may then be slidably supported on and secured to the double layer portion 88 of the formed watch band construction 22 as desired, by inserting the tip portion 82 over the pin 78*b*, into and through the aperture 79*b*, under the face portion 76, into and through the aperture 79*a*, and over the pin 78*a* such that the face portion 76 can be viewed by looking down at the top surface 24 of the blank 20.

The watch band construction 22, with the watch casing 75 slidably supported thereon, can then be secured around a person's wrist by placing the bottom surface 26 of the single layer portion 90 against the person's wrist, (thus placing the top surfaces 24 of the tip portion 82 and the double layer portion 88 against the person's wrist). The tip portion 82 can then be inserted through the U-shaped portion 62 of the watch buckle 60 such that the prong 66 can be inserted through one of the apertures 36, 38, 40, 42, 44, 46, depending on the size of the person's wrist. After the prong 66 is inserted through one of the apertures 36, 38, 40, 42, 44, 46, the prong 66 is positioned against the U-shaped portion 62 and then the tip portion 82 is inserted through the aperture 74 of the keeper 68.

Depending on the size of the person's wrist on which the watch band construction 22 is secured around, there is a possibility that an excess amount of material of the watch band construction 22, including the tip portion 82, which extends beyond the keeper 68, is generally loose and not secured to anything. If desired, this excess amount of material of the watch band construction 22 could be folded back under/over itself and reinserted into the aperture 74 of the keeper 68 in order to secure this excess material of the watch band construction 22. The tip portion 82 preferably being generally angled assists in the reinsertion of the excess amount of material of the watch band construction 22 into the aperture 74 of the keeper 68. Also, the majority of the excess amount of material of the watch band construction 22 is provided in the single layer portion 90 such that it is easier to fold under/over only a single layer of material as opposed to a double layer of material.

Figure 12:
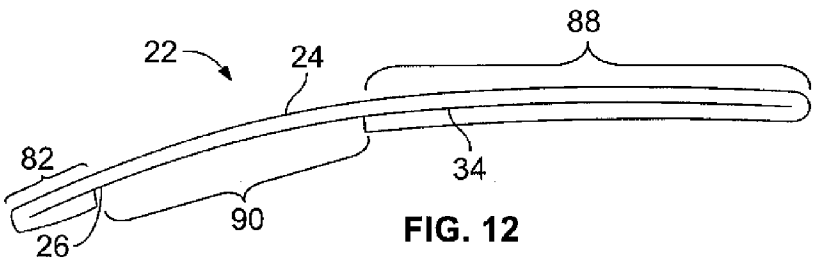
FIG. 12 illustrates a side elevational view of the watch band construction illustrated in FIGS. 4 and 5, without the buckle or keeper illustrated, which demonstrates the increased flexibility and arc bias achieved with the present design.

The watch band construction 22 provides improved durability without sacrificing comfort, ergonomics, styling and ease of use. The tip portion 82 of the watch band construction 22 eliminates a raw edge that improves the durability and aesthetics of the watch band construction 22. The tip portion 82 also facilitates insertion into the watch buckle 60 when the watch band construction 22 is being put on a person's wrist, especially when the fold line 50 is angled as this necessarily causes the tip portion 82 to be narrower at the end thereof, and, also, because of the double layer of the tip portion 82, the tip portion 82 provides a relatively stiff end which further facilitates buckling. The tip portion 82 further creates a gripping edge between the thumb and index finger when the watch band construction 22 is being put on a person's wrist. The double layer portion 88 tends to be stiff and strong because of the double layer of the blank 20, thus providing durability to the watch band construction 22, but also increased aesthetics. As the single layer portion 90 is only a single layer of material, the single layer portion 90 tends to be more flexible and tends to be arc biased, as illustrated in FIG. 12, in that it will tend to flop over or take an arc which facilitates engagement of the tip portion 82 into the watch buckle 60. This flexibility is advantageous to a user when securing the watch to the user's wrist. The arc bias will also generally become more prevalent after the user has secured and unsecured the watch to the wrist multiple times. All of these improvements are designed to assist in the ease of securing the watch band construction 22 to a person's wrist, as it is beneficial to the person to make this securement easy, especially in view of the fact that only one hand (the one not attached to the wrist about which the watch band construction 22 is secured) can be used to perform the securement.

While a preferred embodiment of the invention is shown and described, it is envisioned that those skilled in the art may devise various modifications without departing from the spirit and scope of the foregoing description.

The invention is claimed as follows:

1. A watch band comprising:

an elongated, continuous piece of material defining a tip portion which defines a first end of said watch band, a double layer portion which defines a second end of said watch band, and a single layer portion which is provided between said tip portion and said double layer portion, said tip portion being comprised of first and second layers of said piece of material which are folded over upon one another along a first fold line and secured to one another, said first and second layers of said tip portion causing said tip portion to be relatively stiff and strong to provide durability to said tip portion, said double layer portion being comprised of first and second layers of said piece of material which are folded over upon one another along a second fold line and secured to one another, said double layer portion having an aperture extending through said second fold line, said first and second layers of said double layer portion causing said double layer portion to be relatively stiff and strong to support a watch casing entirely thereon, said single layer being relatively flexible in order to assist in the securement of said watch band;

a watch casing being entirely supported on said double layer portion, said double layer portion and said single layer portion being formed from a continuous piece of material in order to allow the watch casing to be partially supported on said single layer portion;

a watch buckle having a pin member and a prong member extending outwardly from said pin member, said pin member being secured between said first and second layers of said double layer portion proximate to said second fold line, said prong member extending through said aperture of said double layer portion; and prong securement means provided by said single layer portion for securing said prong member, said prong securement means secures said prong member of said watch buckle in order to hold said watch band in place about a user's wrist at a desired fit.

2. The watch band comprising:

an elongated, continuous piece of material defining a tip portion which defines a first end of said watch band, a double layer portion which defines a second end of said watch band, and a single layer portion which is provided between said tip portion and said double layer portion, said tip portion being comprised of first and second layers of said piece of material which are folded over upon one another along a first fold line and secured to one another, said first and second layers of said tip portion causing said tip portion to be relatively stiff and strong to provide durability to said tip portion, said double layer portion being comprised of first and second layers of said piece of material which are folded over upon one another along a second fold line and secured to one another, said double layer portion having an aperture extending through said second fold line, said first and second layers of said double layer portion causing said double layer portion to be relatively stiff and strong to support a watch casing entirely thereon, said single layer being relatively flexible in order to assist in the securement of said watch band, said first and second layers of said double layer portion are secured to one another by stitching, said stitching includes first and second stitchings, said first stitching having a first box stitch proximate to said single layer portion, a second box stitch proximate to said second fold line, and edge stitchings extending between said first and second box stitches, said second stitching being provided between said second box stitch and said second fold line and extending from or proximate to a first edge to or proximate to a second edge;

a watch buckle having a pin member and a prong member extending outwardly from said pin member, said pin member being secured between said first and second layers of said double layer portion proximate to said second fold line, said prong member extending through said aperture of said double layer portion;

prong securement means provided by said single layer portion for securing said prong member, said prong securement means secures said prong member of said watch buckle in order to hold said watch band in place about a user's wrist at a desired fit; and a keeper having top and bottom portions, said bottom portion of said keeper being secured in place between said first and second layers and said first and second stitchings of said double layer portion such that an opening is generally provided between said top portion of said keeper and said first layer of said double layer portion.

3. The watch band as defined in claim 2, wherein said tip portion is generally formed in a configuration of a right triangle with the connection of the perpendicular edges of the triangular portion being provided at the connection of said tip portion to said single layer portion, and wherein said double layer portion is generally formed in a configuration of a rectangle.

4. The watch band as defined in claim 2, wherein said tip portion is configured to he inserted through said opening of said keeper at least one time when said watch band is secured around a wrist of a user.

5. The watch band as defined in claim 2, wherein said pin member of said watch buckle is secured between said second transverse stitching and said second fold line.

6. The watch band as defined in claim 2, wherein said prong securement means are at least one aperture formed through said single layer portion, said at least one aperture being sized to receive said prong member therethrough.

7. The watch band as defined in claim 2, wherein said watch buckle further comprises a generally U-shaped member secured to ends of said pin member, said prong member extends outwardly from said pin member toward said generally U-shaped member, said tip portion configured to extend between said U-shaped member and said double layer portion prior to said prong securement means securing said prong member.

8. The watch band comprising:

an elongated, continuous piece of material defining a tip portion which defines a first end of said watch band, a double layer portion which defines a second end of said watch band, and a single layer portion which is provided between said tip portion and said double layer portion, said tip portion being comprised of first and second layers of said piece of material which are folded over upon one another along a first fold line and secured to one another, said first and second layers of said tip portion causing said tip portion to be relatively stiff and strong to provide durability to said tip portion, said double layer portion being comprised of first and second layers of said piece of material which are folded over upon one another along a second fold line and secured to one another, said double layer portion having an aperture extending through said second fold line, said first and second layers of said double layer portion causing said double layer portion to be relatively stiff and strong, said single layer being relatively flexible in order to assist in the securement of said watch band, a length of said double layer portion is greater than a length of said single layer portion;

a watch casing being entirely supported on said double layer portion;

a watch buckle having a pin member and a prong member extending outwardly from said pin member, said pin member being secured between said first and second layers of said double layer portion proximate to said second fold line, said prong member extending through said aperture of said double layer portion; and prong securement means provided by said single layer portion for securing said prong member, said prong securement means secures said prong member of said watch buckle in order to hold said watch band in place about a user's wrist at a desired fit.

9. The watch band comprising:

an elongated, continuous piece of material defining a tip portion which defines a first end of said watch band, a double layer portion which defines a second end of said watch band, and a single layer portion which is provided between said tip portion and said double layer portion, said tip portion being comprised of first and second layers of said piece of material which are folded over upon one another along a first fold line and secured to one another, said first and second layers of said tip portion causing said tip portion to be relatively stiff and strong to provide durability to said tip portion, said double layer portion being comprised of first and second layers of said piece of material which are folded over upon one another along a second fold line and secured to one another, said double layer portion having an aperture extending through said second fold line, said first and second layers of said double layer portion causing said double layer portion to be relatively stiff and strong to support a watch casing entirely thereon, said single layer being relatively flexible in order to assist in the securement of said watch band;

a watch casing which is supported on said double layer portion, and is slidable onto said single layer portion from said double layer portion to remove the watch casing;

a watch buckle having a pin member and a prong member extending outwardly from said pin member, said pin member being secured between said first and second layers of said double layer portion proximate to said second fold line, said prong member extending through said aperture of said double layer portion; and prong securement means provided by said single layer portion for securing said prong member, said prong securement means secures said prong member of said watch buckle in order to hold said watch band in place about a user's wrist at a desired fit.

10. A watch band comprising:

an elongated, continuous piece of material defining a tip portion which defines a first end of said watch band, a double layer portion which defines a second end of said watch band, and a single layer portion which is provided between said tip portion and said double layer portion, said tip portion being comprised of first and second layers of said piece of material which are folded over upon one another along a first fold line and secured to one another, said first and second layers of said tip portion causing said tip portion to be relatively stiff and strong to provide durability to said tip portion, said double layer portion being comprised of first and second layers of said piece of material which are folded over upon one another along a second fold line and secured to one another, said double layer portion having an aperture extending through said second fold line, said first and second layers of said double layer portion causing said double layer portion to be relatively stiff and strong, said single layer being relatively flexible in order to assist in the securement of said watch band;

a watch casing being entirely supported on said double layer portion such that a first portion of the watch casing is positioned on a first side of the double layer portion and such that a second portion of the watch casing is positioned on a second, opposite side of the double layer portion;

a watch buckle having a pin member and a prong member extending outwardly from said pin member, said pin member being secured between said first and second layers of said double layer portion proximate to said second fold line, said prong member extending through said aperture of said double layer portion; and prong securement means provided by said single layer portion for securing said prong member, said prong securement means secures said prong member of said watch buckle in order to hold said watch band in place about a user's wrist at a desired fit.

* * * * *